United States Patent [19]

Gatsis

[11] Patent Number: 4,904,369

[45] Date of Patent: Feb. 27, 1990

[54] RESIDUAL OIL CONVERSION PROCESS

[75] Inventor: John G. Gatsis, Des Plaines, Ill.

[73] Assignee: UOP, Des Plaines, Ill.

[21] Appl. No.: 270,986

[22] Filed: Nov. 14, 1988

[51] Int. Cl.[4] ..... C10G 21/02; C10G 21/06; C10G 6/714

[52] U.S. Cl. ..... 208/96; 208/100; 208/108; 208/112; 208/162; 208/311; 208/337; 208/323; 210/634; 502/22; 502/31

[58] Field of Search ..... 208/95, 96, 97, 100, 208/108, 112, 305, 311, 323, 337; 502/22, 29, 31; 210/633, 634

[56] References Cited

U.S. PATENT DOCUMENTS

| | | | |
|---|---|---|---|
| 3,117,074 | 1/1964 | Honerkamp et al. | 288/108 |
| 3,240,718 | 3/1966 | Gatsis | 208/264 |
| 3,293,172 | 12/1966 | Gleim | 502/22 |
| 3,461,064 | 8/1969 | Hamilton et al. | 502/33 |
| 3,557,019 | 1/1971 | Van Driesen | 208/112 |
| 3,598,722 | 8/1971 | Carson | 208/108 |
| 3,600,300 | 8/1971 | Steenberg et al. | 208/188 |
| 3,622,495 | 11/1971 | Gatsis et al. | 208/108 |
| 3,622,497 | 11/1971 | Gleim | 502/31 |
| 3,622,498 | 11/1971 | Stolfa et al. | 502/31 |
| 3,671,423 | 6/1972 | MacDonald et al. | 502/31 |
| 3,694,355 | 9/1972 | Visser et al. | 210/634 |
| 3,909,390 | 9/1975 | Urban | 208/435 |
| 4,285,804 | 8/1981 | Jacquin et al. | 208/108 |
| 4,370,236 | 1/1983 | Ferguson | 210/435 |

*Primary Examiner*—Anthony McFarlane

*Attorney, Agent, or Firm*—Thomas K. McBride; John G. Tolomei; John G. Cutts, Jr.

[57] ABSTRACT

A process for the production of hydrogen-enriched hydrocarbonaceous products which process comprises: (a) converting a heavy, asphaltene-containing hydrocarbonaceous residual oil, wherein at least 80% of the residual oil boils above 650° F. (343° C.), in the presence of hydrogen and a particulate catalyst at residual oil conversion conditions in a reaction zone to produce a liquid effluent stream comprising particulate catalyst and normally liquid hydrocarbonaceous compounds; (b) contacting at least a portion of the liquid effluent stream from step (a) with water and a hydrocarbonaceous solvent comprising at least one aromatic hydrocarbon; and (c) gravitationally separating the resulting admixture from step (b) into a solvent phase comprising the normally liquid hydrocarbonaceous compounds and essentially free of solids, and an aqueous phase comprising essentially all of the particulate catalyst.

22 Claims, 1 Drawing Sheet

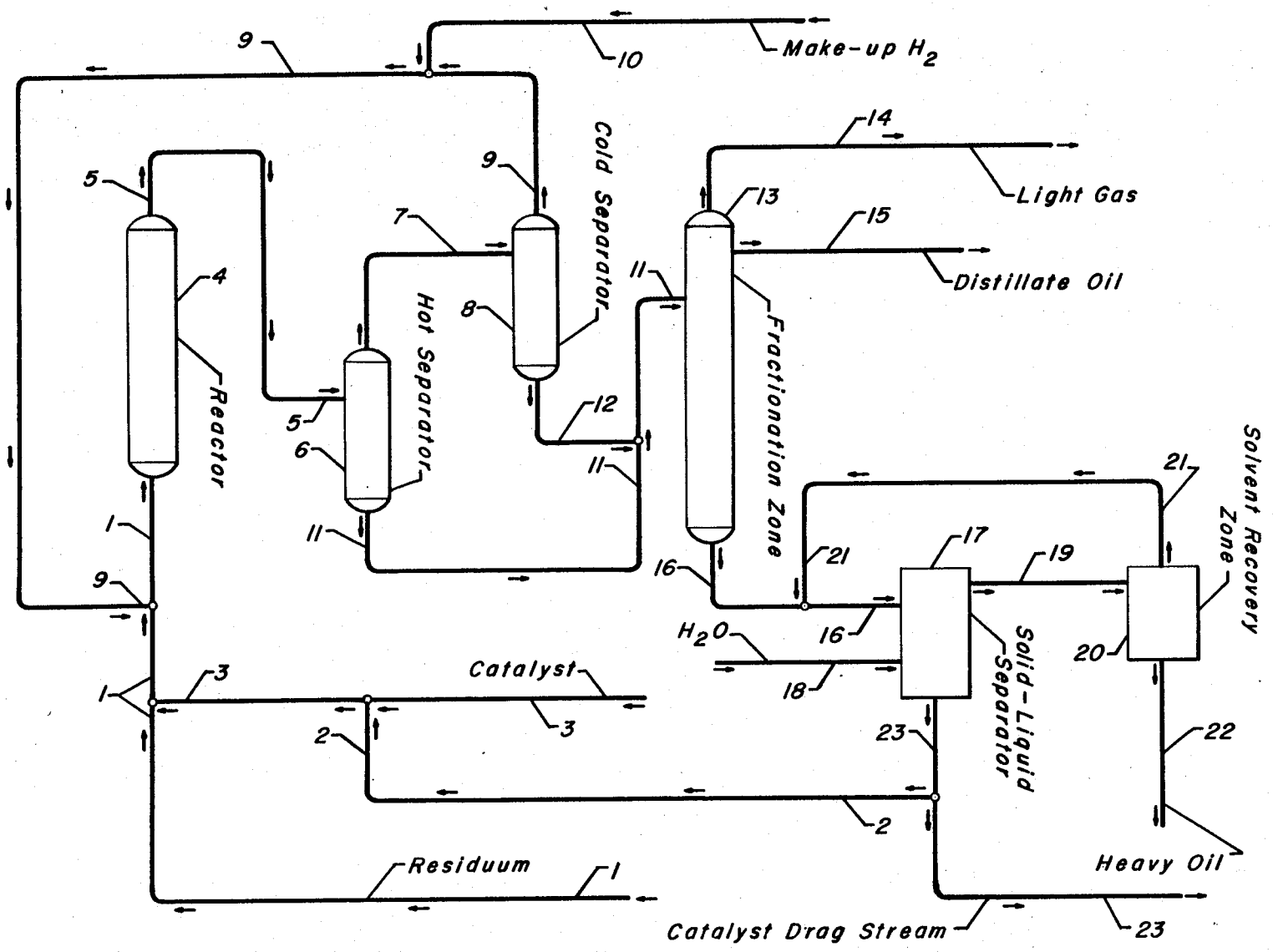
Solvent Recovery Zone
Heavy Oil
Solid-Liquid Separator
Light Gas
Distillate Oil
Make-up $H_2$
Fractionation Zone
Cold Separator
Hot Separator
Reactor
Catalyst
Residuum
Catalyst Drag Stream
$H_2O$
1
2
3
4
5
6
7
8
9
10
11
12
13
14
15
16
17
18
19
20
21
22
23

RESIDUAL OIL CONVERSION PROCESS

FIELD OF THE INVENTION

The invention relates to the broad field of residual oil conversion. More specifically, the invention relates to a process for the production of hydrogen-enriched hydrocarbonaceous products which process comprises: (a) converting a heavy, asphaltene-containing hydrocarbonaceous residual oil, wherein at least 80% of the residual oil boils above 650° F. (343° C.), in the presence of hydrogen and a particulate catalyst at residual oil conversion conditions in a reaction zone to produce a liquid effluent stream comprising particulate catalyst and normally liquid hydrocarbonaceous compounds; (b) contacting at least a portion of the liquid effluent stream from step (a) with water and a hydrocarbonaceous solvent comprising at least one aromatic hydrocarbon; and (c) gravitationally separating the resulting admixture from step (b) into a solvent phase comprising the normally liquid hydrocarbonaceous compounds and essentially free of solids, and an aqueous phase comprising essentially all of the particulate catalyst.

INFORMATION DISCLOSURE

It must be recognized and acknowledged that a considerable amount of technology has been developed with respect to the catalytic slurry processing of hydrocarbonaceous residual oils. In the interest of brevity, only the prior art which is considered most pertinent will be delineated herein.

Subsequent to the conversion of the residual oil in the catalytic conversion zone, the prior art has utilized various recovery techniques for increasing the value and utility of recovered hydrocarbons. However, there has been a remaining persistent problem and that is the problem of recovering the slurry catalyst from the hydrocarbon product. Because of the cost of the catalysts, it has been taught that for a slurry residual oil conversion process to be economical, the catalyst must be recovered to provide a valuable hydrocarbonaceous product, and the catalyst must be subsequently recycled. In any event, before the recovered hydrocarbonaceous values can be subjected to further uses, the slurry catalyst must be isolated and removed. Even when utilizing a once-through or throwaway catalyst, the catalyst must be removed to produce hydrocarbonaceous oil products which meet fuel specifications for ash. The term "ash" as used herein in general refers to ash-forming metals or other inorganic matter which, upon combustion, produces solids.

Therefore, for these and other reasons, none of the aforementioned prior art procedures have been sufficiently commercially attractive or feasible to warrant widespread commercial exploitation of converting residual oil to valuable liquid products. Generally, the deficiencies in the prior art schemes have not only involved capital investment problems and lack of suitable and economical catalyst and catalyst recovery systems, but have also involved liquid product quality and quantity problems which have yet to be solved in an economical and facile manner.

Since it is clear to those skilled in the art that the vast resources of residual oil represent an extremely important supply of energy and an extremely important source of raw materials for valuable chemicals, it would be desirable to improve upon the prior art techniques, particularly the separation of residual oil conversion products from the slurry catalyst.

In U.S. Pat. No. 3,240,718 (Gatsis), a process is disclosed for the regeneration and recovery of a catalyst degradation product from sludge containing the same obtained from the hydrorefining of a petroleum crude with a decomposed organo-metallic catalyst by separating liquid hydrorefining product from the sludge, extracting organic soluble material from the sludge with a solvent therefore, oxidizing the remaining portion of the sludge in the presence of water and recycling the extracted organic soluble material and the oxidized portion of the sludge to untreated charge stock.

BRIEF SUMMARY OF THE INVENTION

The invention provides an improved process for the production of hydrogen-enriched hydrocarbonaceous products from heavy residual hydrocarbonaceous oil. The improvement is obtained through the use of water and a hydrocarbonaceous solvent comprising at least one aromatic hydrocarbon compound to permit an economical and facile method of gravitationally separating a residual oil conversion zone effluent comprising particulate catalyst and normally liquid hydrocarbonaceous compounds to provide a solvent phase comprising said normally liquid hydrocarbonaceous compounds and essentially free of particulate catalyst, and an aqueous phase comprising essentially all of the particulate catalyst.

One broad embodiment of the invention may be characterized as a process for the production of hydrogen-enriched hydrocarbonaceous products which process comprises: (a) converting a heavy, asphaltene-containing hydrocarbonaceous residual oil, wherein at least 80% of the residual oil boils above 650° F. (343° C.), in the presence of hydrogen and a particulate catalyst at residual oil conversion conditions in a reaction zone to produce a liquid effluent stream comprising particulate catalyst and normally liquid hydrocarbonaceous compounds; (b) contacting at least a portion of the liquid effluent stream from step (a) with water and a hydrocarbonaceous solvent comprising at least one aromatic hydrocarbon; and (c) gravitationally separating the resulting admixture from step (b) into a solvent phase comprising the normally liquid hydrocarbonaceous compounds and essentially free of solids, and an aqueous phase comprising essentially all of the particulate catalyst.

Another broad embodiment of the invention may be characterized as a process for the production of hydrogen-enriched hydrocarbonaceous products which process comprises: (a) converting a heavy, asphaltene-containing hydrocarbonaceous residual oil, wherein at least 80% of the residual oil boils above 650° F. (343° C.), in the presence of hydrogen and a particulate catalyst at residual oil conversion conditions in a reaction zone to produce a liquid effluent stream comprising particulate catalyst and normally liquid hydrocarbonaceous compounds; (b) contacting at least a portion of the liquid effluent stream from step (a) with water and a hydrocarbonaceous solvent comprising at least one aromatic hydrocarbon; (c) gravitationally separating the resulting admixture from step (b) into a solvent phase comprising the normally liquid hydrocarbonaceous compounds and essentially free of solids, and an aqueous phase comprising essentially all of the particulate catalyst; and (d) recycling at least a portion of the particulate catalyst recovered in step (c) to step (a).

Yet another broad embodiment of the invention may be characterized as a process for the production of hydrogen-enriched hydrocarbonaceous products which process comprises: (a) converting a heavy, asphaltene-containing hydrocarbonaceous residual oil, wherein at least 80% of the residual oil boils above 650° F. (343° C.) in the presence of hydrogen and a particulate catalyst at residual oil conversion conditions in a reaction zone to produce an effluent stream comprising particulate catalyst, normally liquid hydrocarbonaceous compounds and a hydrogen-rich gas; (b) separating the effluent stream comprising particulate catalyst, normally liquid hydrocarbonaceous compounds and a hydrogen-rich gas to provide a hydrogenrich gaseous stream and a liquid stream comprising particulate catalyst and normally liquid hydrocarbonaceous compounds; (c) contacting at least a portion of the liquid stream comprising particulate catalyst and normally liquid hydrocarbonaceous compounds recovered in step (b) with water and a hydrocarbonaceous solvent comprising at least one aromatic hydrocarbon; and (d) gravitationally separating the resulting admixture from step (c) into a solvent phase comprising the normally liquid hydrocarbonaceous compounds and essentially free of solids, and an aqueous phase comprising essentially all of the particulate catalyst.

BRIEF DESCRIPTION OF THE DRAWING

The drawing is a simplified process flow diagram of a preferred embodiment of the present invention.

DETAILED DESCRIPTION OF THE INVENTION

The production of hydrogen-enriched hydrocarbonaceous products from heavy hydrocarbonaceous residual oil is a highly useful and desirable conversion process. In order to achieve a viable commercial process, the quantity and quality of the hydrogen-enriched liquid hydrocarbonaceous compounds recovered from the residual oil conversion must achieve the highest standard. The quantity of the hydrogen-enriched liquid hydrocarbonaceous compounds is primarily dependent upon an efficient and complete conversion of the residual oil in the reaction zone while it is also understood that essentially all of the liquid hydrocarbonaceous compounds must be recovered in the recovery procedure subsequent to the reaction zone. During efforts to achieve the maximum yield of hydrogen-enriched liquid hydrocarbonaceous compounds, the goal of completely rejecting the particulate catalyst from the liquid hydrocarbonaceous product is essential so that the liquid hydrocarbonaceous product may subsequently be processed and utilized while employing conventional methods and techniques. The prior art processes for the conversion and upgrading of residual oil to produce hydrogen-enriched liquid hydrocarbonaceous product have suffered from various deficiencies which have prevented the economical production of a high quality liquid product.

The present invention provides an improved process for the conversion of hydrocarbonaceous residual oil containing asphaltenes, wherein at least 80% of the residual oil boils above 650° F. (343° C.), into hydrogenenriched hydrocarbonaceous products. I have surprisingly and unexpectedly found that the liquid effluent from a residual oil conversion zone may be successfully separated to provide a normally liquid hydrocarbonaceous product stream which is essentially free of particulate catalyst. Residual oil suitable for use in the practice of the present invention may be selected from the group consisting of whole petroleum crude, reduced petroleum crude, petroleum residuum, tar sand oil, shale oil, coal oil and mixtures thereof.

The preferred operating conditions for the residual oil conversion zone include a temperature from about 400° F. (204° C.) to about 950° F. (510° C.), a pressure from about 500 psig (3447 kPa gauge) to about 5,000 psig (34475 kPa gauge), a residence time from about 30 seconds to about 10 hours, and a hydrogen circulation rate from about 1,000 standard cubic feet per barrel (SCFB) (168.5 normal $m^3/m^3$) to about 15,000 SCFB (2527.5 normal $m^3/m^3$).

Hydrogenation in the residual oil conversion zone, generally, accomplishes the following functions: transfer of hydrogen directly to hydrocarbonaceous oil molecules; transfer of hydrogen to hydrogen-donor molecules; transfer of hydrogen from hydrogen-donor molecules to hydrocarbonaceous oil molecules; hydrogenation of asphaltenes; and various combinations of the above.

In accordance with the present invention, the hydrogenation in the residual oil conversion zone is preferably conducted in the presence of a catalyst in order to enhance and accelerate the hydrogenation and conversion reactions. A preferred catalyst of the present invention comprises a metal sulfide. The catalytic conversion performed by the metal sulfide catalyst may be enhanced by the admixture of hydrogen sulfide with the hydrogen during the practice of the present invention. Hydrogen sulfide is preferably present during the conversion of the residual oil with hydrogen in an amount to provide a hydrogen to hydrogen sulfide molar ratio from about 1 to about 100 and more preferably from about 1 to about 10. The metal sulfide catalyst utilized in the present invention is preferably an unsupported, finely divided metal sulfide. The metal sulfide catalyst which is utilized in the residual oil conversion zone may originate from an external source or may be recycled from a subsequent step wherein said metal sulfide catalyst is segregated and recovered. The unsupported metal sulfide is preferably finely divided and having a nominal diameter or particle size of at least a decimicron with a preferred range of from about 1 micron to about 2,000 microns and with a more preferred range from about 1 micron to about 100 microns. The finely divided, unsupported metal sulfide catalyst may be selected from any convenient metal sulfide. Such metals may be selected from Group V-B including vanadium, niobium and tantalum; Group VI-B including chromium, molybdenum and tungsten; and Group VIII including iron, cobalt, nickel, ruthenium, rhodium, palladium, osmium, iridium, and platinum of the Periodic Table. Preferred metals include vanadium, molybdenum, tungsten, iron, cobalt and nickel.

The use of a particular finely divided solid catalyst in the process of the present invention is not considered to be an essential feature. However, it must be recognized that preferred catalytically active metallic components possess both cracking and hydrogenation activity. The foregoing metallic components may be combined with a refractory inorganic oxide carrier material including alumina, silica, zirconia, magnesia, titania, and mixtures thereof, and the final composite being reduced to a finely divided state. Recent investigations and developments in catalytic slurry processing have indicated that the sulfides of the foregoing metals offer more advantageous results. Furthermore, the process appears to be facilitated when the sulfide of the metal is unsupported, as contrasted to being combined with a refractory inorganic oxide carrier material. Regardless of the character of the catalyst utilized in the present invention, it may be prepared in any suitable, convenient manner and the precise method is not an essential feature of the present invention. For example, vanadium sulfides may be prepared by reducing vanadium pentoxide with sulfuric acid, sulfur dioxide and water to yield a solid hydrate of vanadyl sulfate. The latter is treated with hydrogen sulfide at a temperature of about 300° C. to form vanadium tetrasulfide. Reducing the vanadium tetrasulfide in hydrogen at a temperature of about 300° C. produces the vanadium sulfide which may then be slurried into the system. It is preferred that the concentration of the finely divided catalyst is preferably within the range of about 0.1 percent to about 15 percent by weight, calculated as the elemental metal. Excessive concentrations of catalyst do not appear to enhance the results of the residual oil conversion.

The resulting effluent from the residual oil conversion zone comprises liquid hydrocarbonaceous compounds derived from the heavy hydrocarbonaceous residual oil, and finely divided catalyst particles. Before a residual oil conversion process may be considered complete and successful, this resulting effluent from the residual oil conversion zone must be separated to provide normally liquid hydrocarbonaceous compounds derived from the residual oil and which hydrocarbonaceous compounds are essentially free of catalyst solids. In accordance with the present invention, the term "essentially free of catalyst solids" is defined as a concentration of particulate solid catalyst material of less than about 100 part per million (ppm) by weight.

At least a portion of the liquid effluent stream from the residual oil conversion zone is contacted with water and a hydrocarbonaceous solvent comprising at least one aromatic hydrocarbon compound. The liquid effluent stream may be contacted sequentially with either the water or the hydrocarbonaceous solvent comprising at least one aromatic hydrocarbon compound being first or the liquid effluent stream may be simultaneously contacted with the water and the hydrocarbonaceous solvent. Regardless of the order of contacting the liquid effluent stream, it is preferred that the resulting stream be intimately admixed and allowed to equilibrate before the subsequent gravitational separation. The quantity of water utilized in the contacting step is preferably present in an amount sufficient to provide a weight ratio of water to solids contained in the hydrocarbonaceous liquid effluent stream from the residual oil conversion zone from about 0.1:1 to about 10:1. The quantity of hydrocarbonaceous solvent comprising at least one aromatic hydrocarbon compound utilized in the contacting step is preferably present in an amount sufficient to provide a volume ratio of the hydrocarbonaceous solvent to hydrocarbonaceous liquid effluent stream from the conversion zone from about 0.1:1 to about 5:1. The hereinabove described contacting performed in accordance with the present invention is preferably conducted at conditions which include a temperature from about ambient to about 500° F. (260° C.) and a pressure from about atmospheric to about 1000 psig (6895 kPa gauge).

The resulting admixture provided by the contacting of at least a portion of the hydrocarbonaceous liquid effluent stream from the residual oil conversion zone with water and a hydrocarbonaceous solvent comprising at least one aromatic hydrocarbon compound is subsequently gravitationally separated to provide a solvent phase comprising normally liquid hydrocarbonaceous compounds and essentially free of catalyst solids, and an aqueous phase comprising essentially all of the particulate catalyst which was present in the hydrocarbonaceous liquid effluent stream. This gravitational separation may be performed in any suitable and convenient manner such as, for example, settling, decanting or centrifuging. In accordance with the present invention, the gravitational separation is preferably conducted at conditions which include a temperature from about ambient to about 500° F. (260° C.), a pressure from about atmospheric to about 1000 psig (6895 kPa gauge) and a residence time from about 1 second to about 100 minutes.

In accordance with one embodiment of the present invention, it is preferred that after an aqueous slurry of catalyst is recycled and admixed with the fresh petroleum residuum feedstock, at least a majority of the aqueous component of the slurry is removed from the admixture prior to the introduction of the feedstock into the conversion reaction zone.

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such appurtenances are well within the purview of one skilled in the art.

With reference now to the drawing, a petroleum residuum feed is introduced into the process via conduit 1 and a finely divided catalyst is introduced via conduit 3. The resulting admixture of petroleum residuum and catalyst particles which is carried via conduit 1 is contacted with a gaseous hydrogen-rich recycle stream which is provided via conduit 9 and hereinafter described. The resulting admixture of residuum, catalyst and hydrogen-rich gas is heated and introduced via conduit 1 into reactor 4. A resulting effluent stream comprising normally liquid hydrocarbonaceous compounds and catalyst particles is removed from reactor 4 via conduit 5 and introduced into hot separator 6. A hot gaseous stream comprising hydrogen and distillable hydrocarbonaceous compounds is removed from hot separator 6 via conduit 7, cooled and introduced into cold separator 8. A hydrogen-rich gaseous stream is removed from cold separator 8 via conduit 9 and recycled to the incoming fresh residual oil feed as described hereinabove. Since hydrogen is lost in the process by means of a portion of the hydrogen being dissolved in the exiting liquid streams and hydrogen being consumed during the conversion of residuum into distillable liquid hydrocarbonaceous compounds, it is necessary to supplant the hydrogen-rich gaseous stream with make-up hydrogen from some suitable external source, for example, a catalytic reforming unit or a hydrogen plant. Make-up hydrogen may be introduced into the system at any convenient and suitable point, and is introduced in the drawing via conduit 10. A distillable hydrocarbonaceous compound containing stream is removed from cold separator 8 via conduit 12 and introduced into fractionation zone 13 via conduits 12 and 11. A heavy stream containing normally liquid hydrocarbonaceous compounds and catalyst particles is removed from hot separator 6 via conduit 11 and introduced into fractionation zone 13. A gaseous stream comprising hydrogen and any normally gaseous hydrocarbons present is removed from fractionation zone 13 via conduit 14 and recovered. A distillate hydrocarbonaceous oil stream comprising normally liquid hydrocarbonaceous compounds is removed from fractionation zone 13 via conduit 15 and recovered. A heavy stream comprising high-boiling hydrocarbonaceous compounds and catalyst particles is removed from fractionation zone 13 via conduit 16 and is contacted with a hydrocarbonaceous solvent comprising at least one aromatic hydrocarbon compound which is introduced via conduit 21. The resulting admixture is then introduced into solid-liquid separator 17 via conduit 16. An aqueous stream is introduced via conduit 18 into solid-liquid separator 17. A solvent-rich phase comprising normally liquid hydrocarbonaceous compounds which phase is essentially free of solids is removed from solid-liquid separator 17 via conduit 19 and introduced into solvent recovery zone 20. A hydrocarbonaceous solvent comprising at least one aromatic hydrocarbon compound is recovered from solvent recovery zone 20 and removed via conduit 21 for recycle as hereinabove described. A heavy, high-boiling hydrocarbonaceous oil is recovered and removed from solvent recovery zone 20 via conduit 22. An aqueous solids slurry stream comprising catalyst particles is removed from solid-liquid separator 17 via conduit 23 and recovered. At least a portion of the aqueous solids slurry stream comprising catalyst particles is recycled to the fresh feed stream via conduits 23, 2 and 3 as described hereinabove.

The following example is presented for the purpose of further illustrating the process of the present invention and to indicate the benefits afforded by the utilization thereof. It is not intended that the present invention be unduly limited by the example presented.

EXAMPLE

Weighed amounts of residual petroleum crude oil having the characteristics presented in Table 1 and a particulate vanadium catalyst were added to an 1800 cc autoclave. The autoclave was sealed and purged with nitrogen. The pressure was then slowly increased to 100 atm. with a hydrogen/hydrogen sulfide gas mixture through a displacement meter system. The autoclave was systematically heated to 420° C. and was then maintained at 200 atm. for 2 hours. Hydrogen was automatically added so that the 200 atm. pressure was maintained. The autoclave was then cooled to room temperature, and was then depressured with the gas passing through a foam trap, caustic scrubbers, metering system and then a sample was collected for analysis. To remove additional gas from the remaining reaction mixture, the material in the autoclave was stripped with nitrogen. This gas also was passed through the foam trap, caustic scrubbers, metering system and analyzed. Any slurry product recovered in the foam trap was recovered with toluene and added to the toluene rinse solution.

TABLE 1

ANALYSIS OF RESIDUAL PETROLEUM CRUDE OIL

| | | |
|---|---|---|
| Specific Gravity | 1.025 | |
| Distillation (D-1160) | °F. | (°C.) |
| IBP | 696 | (369) |
| 5 Volume Percent | 810 | (432) |
| 10 Volume Percent | 865 | (463) |
| 20 Volume Percent | 941 | (505) |
| EP | 982 | (523) |
| Overhead, Volume Percent | 26.5 | |

TABLE 1-continued

ANALYSIS OF RESIDUAL PETROLEUM CRUDE OIL

| Component, Weight Percent | |
|---|---|
| Carbon | 83.7 |
| Hydrogen | 10.0 |
| Sulfur | 5.1 |
| Heptane Insolubles | 13.9 |

The slurry product from the autoclave was poured into a 5 liter stainless steel beaker containing 100 g of water. The material remaining in the autoclave was removed by rinsing the vessel with toluene until the autoclave was clean. The toluene rinse solution was also added to the 5 liter stainless steel beaker.

The sample contained in the 5 liter stainless steel beaker was sonified for 2 hours and allowed to stand for 30 minutes. The sample was then centrifuged to separate toluene soluble phase from aqueous slurry phase. Toluene was used to transfer all of the aqueous slurry phase to a centrifuge cup. The centrate liquid (toluene soluble phase) was decanted, filtered and flashed on a rotary evaporator to remove the toluene solvent.

Toluene was added to the centrifuge cup containing aqueous slurry phase and the sample was sonified to thoroughly disperse the particulate catalyst. The resulting dispersed sample was transferred to the autoclave containing a fresh charge of residual petroleum crude oil. The autoclave was then sealed and flushed out with nitrogen. The autoclave was heated to 150° C. under vacuum to remove water and toluene which are recovered in a dry-ice trap. Residual petroleum crude oil conversion was then repeated at the same conditions described hereinabove. The converted residual petroleum crude oil was recovered in accordance with the method described hereinabove. A total of five tests were conducted in the manner hereinabove described and the results of these tests are presented and summarized in Table 2 and Table 3.

TABLE 2

AUTOCLAVE TEST
LIQUID PRODUCT PROPERTIES-CONVERSIONS

| TEST NO. | 1 | 2 | 3 | 4 | 5 |
|---|---|---|---|---|---|
| Residual Oil, g | 454.0 | 403.5 | 443.6 | 443.2 | 428.5 |
| Catalyst, g of Vanadium | 4.20 | — | — | — | — |
| Liquid Product Properties | | | | | |
| API @ 15.6° C. | 15.1 | 14.1 | 13.4 | 13.3 | 13.4 |
| Sulfur, Wt. % | 2.31 | 2.75 | 2.84 | 3.02 | 3.12 |
| $C_7$ Insolubles, Wt. % | 5.23 | 5.28 | 5.67 | 5.66 | 5.37 |
| 371° C.+, Wt. % | 58.59 | 69.84 | 67.61 | 69.20 | 69.22 |
| 510° C.+, Wt. % | 25.70 | 33.51 | 31.07 | 32.82 | 34.17 |
| Conversions | | | | | |
| Sulfur | 65.6 | 57.8 | 58.4 | 55.5 | 53.1 |
| $C_7$ Insolubles | 71.5 | 70.6 | 69.6 | 69.4 | 70.4 |
| 371° C.+ | 54.8 | 45.1 | 48.7 | 47.2 | 45.7 |
| 510° C.+ | 75.4 | 67.3 | 70.8 | 68.9 | 67.0 |
| Relative Activity (Based on $C_7$ Insol. Conv.) | 100 | 97.7 | 94.9 | 94.5 | 97.0 |

TABLE 3

AUTOCLAVE TEST
PRODUCT DISTRIBUTION

| TEST NO. | 1 | 2 | 3 | 4 | 5 |
|---|---|---|---|---|---|
| Product Distribution | | | | | |
| $H_2S$, Wt. % | 3.3 | 3.0 | 3.0 | 2.8 | 2.7 |
| Hydrocarbon Gas, Wt. % | 5.6 | 4.8 | 6.7 | 5.4 | 4.3 |

TABLE 3-continued

| AUTOCLAVE TEST PRODUCT DISTRIBUTION | | | | | |
|---|---|---|---|---|---|
| TEST NO. | 1 | 2 | 3 | 4 | 5 |
| IBP-371° C., Wt. % | 31.4 | 23.3 | 24.1 | 23.2 | 23.2 |
| 371-510+° C., Wt. % | 25.0 | 28.2 | 27.3 | 27.3 | 28.3 |
| 510° C.+ | 19.5 | 25.9 | 23.2 | 24.7 | 25.2 |
| Total, Wt. %* | 84.8 | 85.2 | 84.3 | 83.4 | 83.7 |
| $H_2$ Consumption | | | | | |
| g $H^2$/100 g Feed | 1.55 | 1.00 | 0.95 | 0.99 | |
| SCF/bbl | 1051 | 677 | 645 | 672 | |

*Low recoveries due to loss of light-ends in rotary flash evaporation of toluene soluble product.

After the last test, the catalyst was recovered and the excess water contained in the centrifuge cup containing the aqueous slurry phase of the catalyst particles was filtered. The wet solids were placed in a vacuum oven and evacuated at 110° C. under a nitrogen blanket for 2 hours. The vacuum oven was then cooled to room temperature and the dried catalyst was analyzed for vanadium. The dried catalyst was found to contain 3.44 g of vanadium which accounted for 81.9 wt. % of the vanadium contained in the vanadium sulfide catalyst which was charged to the autoclave in the initial test. The unaccounted vanadium was believed to be caused by handling loss since the recovered hydrocarbonaceous oil contained essentially no particulate matter and was found to contain less than 50 ppm vanadium.

Based on the hereinabove presented results, the present invention is a highly efficient process for the production of hydrogen-enriched hydrocarbonaceous products essentially free of solids and which process is able to maintain a high level of catalyst activity during residual oil conversion.

The foregoing description, drawing and example clearly illustrate the advantages encompassed by the process of the present invention and the benefits to be afforded with the use thereof.

I claim as my invention:

1. A process for the production of hydrogenenriched hydrocarbonaceous products which process comprises:
   (a) converting a heavy, asphaltene-containing hydrocarbonaceous residual oil, wherein at least 80% of said residual oil boils above 650° F. (343° C.), in the presence of hydrogen and a particulate catalyst at residual oil conversion conditions in a reaction zone to produce a liquid effluent stream comprising particulate catalyst and normally liquid hydrocarbonaceous compounds;
   (b) contacting at least a portion of said liquid effluent stream from step (a) with water and a hydrocarbonaceous solvent comprising at least one aromatic hydrocarbon; and
   (c) gravitationally separating the resulting admixture from step (b) into a solvent phase comprising said normally liquid hydrocarbonaceous compounds and essentially free of solids, and an aqueous phase comprising essentially all of said particulate catalyst.

2. The process of claim 1 wherein said hydrocarbonaceous residual oil is selected from the group consisting of whole petroleum crude, reduced petroleum crude, tar sand oil, shale oil, coal oil and mixtures thereof.

3. The process of claim 1 wherein said particulate catalyst comprises a metallic component.

4. The process of claim 3 wherein said metallic component is selected from the metals of Groups VB, VIB, and VIII of the Periodic Table.

5. The process of claim 1 wherein said residual oil conversion conditions include a pressure from about 500 psig (3447 kPa gauge) to about 5000 psig (34475 kPa gauge), a temperature from about 400° F. (204° C.) to about 950° F. (510° C.), and a hydrogen circulation rate from about 1000 SCFB (168.5 n $m^3$/m) to about 15,000 SCFB (2527.5 n $m^3/m^3$).

6. The process of claim 1 wherein said water is present in an amount sufficient to provide a weight ratio of said water to said particulate catalyst contained in said liquid effluent stream recovered in step (a) from about 0.1:1 to about 10:1.

7. The process of claim 1 wherein said hydrocarbonaceous solvent comprising at least one aromatic hydrocarbon compound is present in an amount sufficient to provide a volume ratio of said hydrocarbonaceous solvent to said liquid effluent stream recovered in step (a) from about 0.1 to about 5:1.

8. The process of claim 1 wherein said contacting in step (b) is conducted at conditions which include a temperature from about ambient to about 500° F. (260° C.) and a pressure from about ambient to about 1000 psig (6895 kPa gauge).

9. The process of claim 1 wherein said separating in step (c) is conducted at conditions which include a temperature from about ambient to about 500° F. (260° C.), a pressure from about ambient to about 1000 psig (6895 kPa gauge) and a residence time from about 1 second to about 100 minutes.

10. The process of claim 1 wherein said solvent phase comprising said normally liquid hydrocarbonaceous compounds recovered in step (c) contains less than about 100 ppm solids.

11. A process for the production of hydrogen-enriched hydrocarbonaceous products which process comprises:
   (a) converting a heavy, asphaltene-containing hydrocarbonaceous residual oil, wherein at least 80% of said residual oil boils above 650° F. (343° C.), in the presence of hydrogen and a particulate catalyst at residual oil conversion conditions in a reaction zone to produce a liquid effluent stream comprising particulate catalyst and normally liquid hydrocarbonaceous compounds;
   (b) contacting at least a portion of said liquid effluent stream from step (a) with water and a hydrocarbonaceous solvent comprising at least one aromatic hydrocarbon;
   (c) gravitationally separating the resulting admixture from step (b) into a solvent phase comprising said normally liquid hydrocarbonaceous compounds and essentially free of solids, and an aqueous phase comprising essentially all of said particulate catalyst; and
   (d) recycling at least a portion of said particulate catalyst recovered in step (c) to step (a).

12. The process of claim 11 wherein said hydrocarbonaceous residual oil is selected from the group consisting of whole petroleum crude, reduced petroleum crude, tar sand oil, shale oil, coal oil and mixtures thereof.

13. The process of claim 11 wherein said particulate catalyst comprises a metallic component.

14. The process of claim 13 wherein said metallic component is selected from the metals of Groups VB, VIB, and VIII of the Periodic Table.

15. The process of claim 11 wherein said residual oil conversion conditions include a pressure from about 500 psig (3447 kPa gauge) to about 5000 psig (34475 kPa gauge), a temperature from about 400° F. (204° C.) to about 950° F. (510° C.), and a hydrogen circulation rate from about 1000 SCFB (168.5 n $m^3/m$) to about 15,000 SCFB (2527.5 n $m^3/m^3$).

16. The process of claim 11 wherein said water is present in an amount sufficient to provide a weight ratio of said water to said particulate catalyst contained in said liquid effluent stream recovered in step (a) from about 0.1:1 to about 10:1.

17. The process of claim 11 wherein said hydrocarbonaceous solvent comprising at least one aromatic hydrocarbon compound is present in an amount sufficient to provide a volume ratio of said hydrocarbonaceous solvent to said liquid effluent stream recovered in step (a) from about 0.1 to about 5:1.

18. The process of claim 11 wherein said contacting in step (b) is conducted at conditions which include a temperature from about ambient to about 500° F. (260° C.) and a pressure from about ambient to about 1000 psig (6895 kPa gauge).

19. The process of claim 11 wherein said separating in step (c) is conducted at conditions which include a temperature from about ambient to about 500° F. (260° C.), a pressure from about ambient to about 1000 psig (6895 kPa gauge) and a residence time from about 1 second to about 100 minutes.

20. The process of claim 11 wherein said solvent phase comprising said normally liquid hydrocarbonaceous compounds recovered in step (c) contains less than about 100 ppm solids.

21. The process of claim 11 wherein said particulate catalyst recovered in step (c) and recycled to step (a) comprises from about 50 to about 100 percent of the total particulate catalyst utilized in said reaction zone.

22. A process for the production of hydrogen-enriched hydrocarbonaceous products which process comprises:

(a) converting a heavy, asphaltene-containing hydrocarbonaceous residual oil, wherein at least 80% of said residual oil boils above 650° F. (343° C.), in the presence of hydrogen and a particulate catalyst at residual oil conversion conditions in a reaction zone to produce an effluent stream comprising particulate catalyst, normally liquid hydrocarbonaceous compounds and a hydrogen-rich gas;

(b) separating said effluent stream comprising particulate catalyst, normally liquid hydrocarbonaceous compounds and a hydrogen-rich gas to provide a hydrogen-rich gaseous stream and a liquid stream comprising particulate catalyst and normally liquid hydrocarbonaceous compounds;

(c) contacting at least a portion of said liquid stream comprising particulate catalyst and normally liquid hydrocarbonaceous compounds recovered in step (b) with water and a hydrocarbonaceous solvent comprising at least one aromatic hydrocarbon; and (d) gravitationally separating the resulting admixture from step (c) into a solvent phase comprising said normally liquid hydrocarbonaceous compounds and essentially free of solids, and an aqueous phase comprising essentially all of said particulate catalyst.

* * * * *